US010329961B2

(12) United States Patent
Springer et al.

(10) Patent No.: US 10,329,961 B2
(45) Date of Patent: Jun. 25, 2019

(54) SENSORLESS CONDENSER REGULATION FOR POWER OPTIMIZATION FOR ORC SYSTEMS

(71) Applicant: ORCAN ENERGY AG, München (DE)

(72) Inventors: Jens-Patrick Springer, München (DE); Andreas Grill, München (DE)

(73) Assignee: ORCAN ENERGY AG, München (DE)

( * ) Notice: Subject to any disclaimer, the term of this patent is extended or adjusted under 35 U.S.C. 154(b) by 256 days.

(21) Appl. No.: 15/106,709

(22) PCT Filed: Sep. 3, 2014

(86) PCT No.: PCT/EP2014/068740
§ 371 (c)(1),
(2) Date: Jun. 20, 2016

(87) PCT Pub. No.: WO2015/090648
PCT Pub. Date: Jun. 25, 2015

(65) Prior Publication Data

US 2017/0002693 A1 Jan. 5, 2017

(30) Foreign Application Priority Data

Dec. 20, 2013 (EP) ..... 13198793

(51) Int. Cl.
*F01K 13/02* (2006.01)
*F01K 9/00* (2006.01)
(Continued)

(52) U.S. Cl.
CPC ..... *F01K 13/02* (2013.01); *F01K 9/003* (2013.01); *F01K 11/00* (2013.01); *F28B 1/06* (2013.01); *F28B 11/00* (2013.01); *F01K 25/08* (2013.01)

(58) Field of Classification Search
CPC ..... F01K 11/00; F01K 13/02; F01K 9/003; F01K 25/08; F28B 1/06; F28B 11/00
See application file for complete search history.

(56) References Cited

U.S. PATENT DOCUMENTS 3,578,871 A * 5/1971 Sakamoto ..... H02P 23/16 318/563
3,723,018 A * 3/1973 Uchiyama ..... F01D 17/18 415/1

(Continued)

FOREIGN PATENT DOCUMENTS

EP 1624269 A2 2/2006
GB 2473543 A 3/2011

OTHER PUBLICATIONS

European Search Report for European Patent Application No. EP13198793.5 dated Jun. 11, 2014.

(Continued)

*Primary Examiner* — Laert Dounis
*Assistant Examiner* — Matthew T Largi
(74) *Attorney, Agent, or Firm* — Moore & Van Allen PLLC; Henry B. Ward, III

(57) ABSTRACT

The invention relates to a method for regulating a condenser in a thermal cycle apparatus, in particular in an ORC apparatus, wherein the thermal cycle apparatus comprises a feed pump for conveying liquid working medium with an increase in pressure to an evaporator, the evaporator for evaporating and optionally additionally superheating the working medium with a supply of heat, an expansion machine for generating mechanical energy by expansion of the evaporated working medium, a generator for at least partially converting the mechanical energy into electrical energy, and the condenser for condensing the expanded working medium, and wherein the method comprises the following steps: determining a rotational speed of the gen- (Continued)

erator or of the expansion machine; determining, without the use of a temperature sensor, a temperature of cooling air supplied from the condenser; determining from the determined generator or expansion machine rotational speed and the determined cooling air temperature, a condensation setpoint pressure at which the net electrical power of the thermal cycle apparatus is at a maximum; and controlling or regulating the condensation pressure, with the condensation setpoint pressure as target value, in particular by adjusting a condenser fan rotational speed.

17 Claims, 1 Drawing Sheet

(51) Int. Cl.

| | |
|---|---|
| ***F28B 1/06*** | (2006.01) |
| ***F28B 11/00*** | (2006.01) |
| ***F01K 11/00*** | (2006.01) |
| *F01K 25/08* | (2006.01) |

(56) References Cited

U.S. PATENT DOCUMENTS

| | | | | |
|---|---|---|---|---|
| 4,153,198 | A * | 5/1979 | Eki | F01D 17/24 700/290 |
| 4,302,813 | A * | 11/1981 | Kurihara | F01D 19/00 702/56 |
| 6,128,905 | A | 10/2000 | Fahlsing | |
| 9,869,199 | B2 * | 1/2018 | Larcheveque | F01D 21/18 |
| 2005/0022497 | A1 * | 2/2005 | Takai | F01K 23/101 60/39.182 |
| 2006/0032606 | A1 * | 2/2006 | Thybo | B60H 1/00978 165/11.1 |
| 2011/0066298 | A1 * | 3/2011 | Francino | F01K 9/003 700/290 |

OTHER PUBLICATIONS

Written Opinion for International Patent Application No. PCT/EP2014/068740 dated Feb. 5, 2015.

International Search Report for International Patent Application No. PCT/EP2014/068740 dated Feb. 5, 2015 (English translation attached herewith)

* cited by examiner

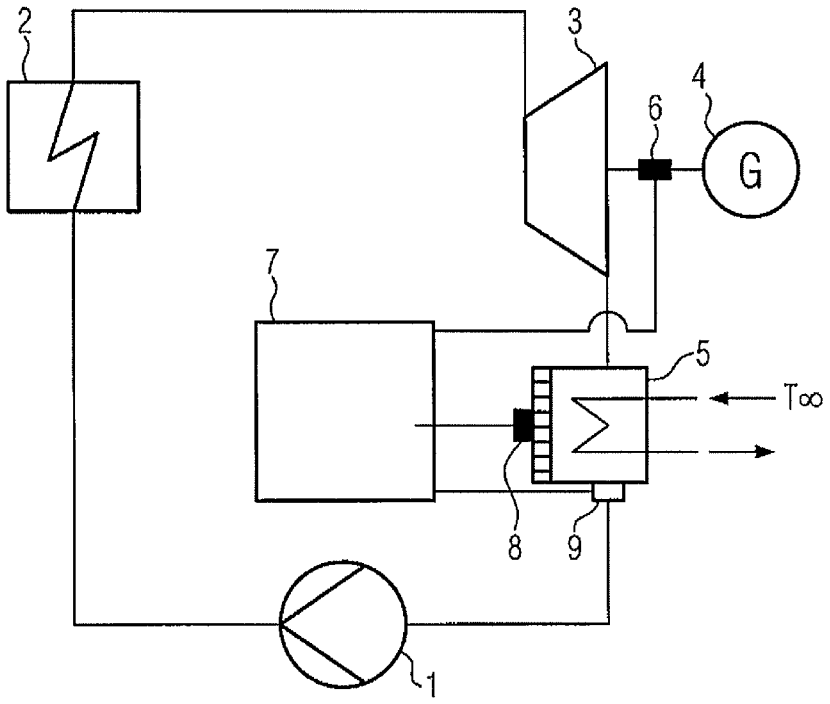
2
3
4
6
G
7
5
T∞
8
9
1

SENSORLESS CONDENSER REGULATION FOR POWER OPTIMIZATION FOR ORC SYSTEMS

FIELD OF THE INVENTION

The invention relates to a method for regulating a condenser in a thermal cycle apparatus, in particular in an ORC apparatus, and to an appropriate device.

STATE OF THE ART

A system for generating electrical energy from thermal energy by means of the Organic Rankine Cycle as thermodynamic cycle system (ORC system) consists of the following main components: a feed pump, for conveying liquid working medium with an increase in pressure to an evaporator, the evaporator for evaporating and optionally additionally superheating the working medium with a supply of heat, an expansion machine for generating mechanical energy by expansion of the evaporated working medium, a generator for at least partially converting the mechanical energy into electrical energy, and the condenser for condensing the expanded working medium. From the condenser, via an optional reservoir (feed tank) and a suction pipe, the expanded working medium again is supplied to the feed pump of the system.

Every load status has a condensation pressure maximizing the net power within the system specification (optimal condensation pressure). The condensation pressure here and in the following indicates the pressure at the output of the condenser.

The usable electrical power resulting from the ORC process is the net power. This comprises the gross power less on-site power of the system. The on-site power comprises values being independent from the load status, as e.g. power supply of the control and values being dependent from the load status. Important dependent values are the power demand of the feed pump and the power demand of the fan or of the condenser fans. In respect of the power demand of the condenser fan, a very strong disproportionate connection between the on-site consumption and the fan rotational speed appears. At a higher rotational speed, the condensation pressure is reduced, whereby the enthalpy gradient of the upstream expansion machine increases. Thus, the latter can achieve a higher (gross) power. Hence, the question arises if this increase of the gross power exceeds the increased on-site power due to the increased electrical power consumption of the condenser fan, or not.

It has to be considered how on-site power and gross power behave in the prevailing environmental conditions. At the point, at which the gross power increases more slowly than the on-site power of the condenser declines, lies the optimum of the condensation pressure in a prevailing load state. The issue which condensation pressure is optimal depends on the status of the system. The status of the system is affected by two factors: The current power (thermal power, gross power) and the environmental conditions (temperature).

Thus, the condenser should always control the pressure, at which a possibly optimal net gain can be achieved. This pressure depends on the load status, the specifications of the condenser, and on the air temperature, possibly even on the status of the condenser, namely e.g. in case the heat transfer coefficient or the available surface changes due to contamination. The load status can be measured and/or calculated. The features of the condenser are known. The outside temperature needs to be measured. This measurement, however, frequently is unreliable and prone to error. This is due to fact that e.g. solar radiation may distort the measurement result. Moreover, the measurement result depends on the exact choice of location of the temperature sensor on the system and, thus, requires a respective calibration.

A reliable measurement of the outside temperature with required accuracy, therefore, in many cases is a difficult object, as influence factors, like solar radiation, thermal radiation of buildings and plants, exhaust air of processes etc. may significantly impede or distort the measurement. A further issue is that not the general ambient temperature determines the condensation, but the average temperature of the air at the access of the condenser. A measurement with several sensors in the incoming air (supplied air), which, however, are separated from the thermal radiation, is economically unfavorable.

DESCRIPTION OF THE INVENTION

The problem underlying the present invention is to overcome the above described disadvantages, at least partially. If possible, a temperature measurement should be waived. Further, suitable setpoints of the condensation pressure of the condensation are to be determined for the starting procedure of the system.

This problem is solved by a method according to claim 1. According to the invention, a method for regulating a condenser in a thermal cycle apparatus, in particular in an ORC apparatus is provided, wherein the thermal cycle apparatus comprises a feed pump for conveying liquid working medium with an increase in pressure to an evaporator, the evaporator for evaporating and optionally additionally superheating the working medium with a supply of heat, an expansion machine for generating mechanical energy by expansion of the evaporated working medium, a generator for at least partially converting the mechanical energy into electrical energy, and the condenser for condensing the expanded working medium, and wherein the method comprises the following steps: determining, in particular measuring, a rotational speed of the generator or of the expansion machine; determining, without the use of a temperature sensor, a temperature of cooling air supplied from the condenser; determining, from the determined generator or expansion machine rotational speed and the determined cooling air temperature, a condensation setpoint pressure at which the net electrical power of the thermal cycle apparatus is at a maximum; and controlling or regulating the condensation pressure, with the condensation setpoint pressure as target value, in particular by adjusting a condenser fan rotational speed.

The advantages consist in the fact that always the condensation pressure can be controlled that results in a higher net gain. Moreover, the outside temperature must not be measured that involves a cost reduction and a lower probability of implementation errors, as the determination of the cooling air temperature being supplied from the condenser, occurs without temperature sensor. The thereby determined temperature can also be referred to as effective outside temperature or effective air temperature. Determining the rotational speed of the generator may e.g. occur from the electrical signals from or to the generator, or by measuring by means of a rotational speed sensor.

The method according to the invention can be further developed in a way that determining of the cooling air temperature without using temperature sensors comprises a calculation of the temperature from a determined, in particular measured rotational speed of the generator or the expansion machine, a determined, in particular measured rotational speed of the condenser fan and a determined, in particular measured condensation pressure; or wherein determining the cooling air temperature without using temperature sensors comprises sampling the temperature from a predetermined table depending on a determined, in particular measured rotational speed of the generator or the expansion machine, a determined, in particular measured rotational speed of the condenser fan, and a determined, in particular measured condensation pressure. Determining the temperature of the cooling air, thus, occurs via model predicative regulation control strategies (MPC), in which defined process variables from other process variables by means of knowledge of the process and its components are determined via models. Determining the rotational speed of the condenser fan, e.g. may occur from the electrical signals from or to the condenser fan. Determining the condensation pressure, e.g. may also occur from a measured temperature of the condensate.

According to a further embodiment, during starting the thermo-dynamic cycle apparatus, initially, the following steps are carried out: determining a start value for the condensation setpoint pressure; starting the thermo-dynamic cycle apparatus and controlling or regulating the condensation pressure with the start value of the condensation setpoint pressure as target value by means of adjusting the condenser fan rotational speed; and replacing the start value for the condensation setpoint value with the condensation setpoint value determined during the operation of the thermo-dynamic cycle apparatus.

This may be developed in a way that as start value for the condensation setpoint value the saturation pressure of the working medium at the current condensate temperature or the saturation pressure at the temperature of the working medium at an inlet of the feed pump, in particular with additional setpoint sub-cooling of the working medium, the actual pressure in standstill of the thermo-dynamic cycle apparatus, or the last condensation setpoint pressure during the last operation of the thermo-dynamic cycle apparatus can be determined. The setpoint sub-cooling thereby refers to as the temperature difference about which the condensate is sub-cooled vis-à-vis the condensation saturation temperature. This has the advantage that the cavitation risk in the feed pump is reduced.

According to a further embodiment, replacing during starting occurs by means of controlling or regulating the condensation pressure from the start value of the condensation pressure to the setpoint condensation pressure determined after starting during operation of the thermo-dynamic cycle apparatus. This has the advantage that a smooth transition of controlling and/or regulating occurs and, thus, abrupt changes are avoided. A transition from a start value to an optimal setpoint condensation pressure is to be occurred. The start value may be determined by different methods and is uniquely specified during starting the system. Then, however, from this value, it is to be passed over to the optimal setpoint condensation pressure, without too rapid pressure changes taking place, as e.g. it would be the case during abruptly switching to the optimal setpoint condensation pressure. Therefore, the setpoint value starting from the start value with a maximal modification speed to the optimal setpoint condensation pressure is to be changed. As soon as the setpoint value has reached the optimal setpoint condensation pressure, it may be switched to the above described control method according to the invention.

According to a further embodiment, subsequent to a shut-down of the thermo-dynamic cycle apparatus, the following steps may be carried out: determining a shut-down value for the setpoint condensation pressure; replacing the setpoint condensation pressure determined during operation of the thermodynamic cycle apparatus with the shut-down value for the setpoint condensation pressure as target value by means of adjusting the condenser fan rotational speed and stopping the operation of the thermo-dynamic cycle apparatus.

This may be further developed in a way that as shut-down value the last setpoint condensation pressure during the last operation of the thermo-dynamic cycle apparatus or the saturation pressure of the working medium at current condensate temperature, in particular with an additional setpoint sub-cooling of the condensate, may be specified.

According to a further embodiment, replacing occurs during shut-down by means of controlling and regulating the condensation pressure of the setpoint condensation pressure determined during operation of the thermo-dynamic cycle apparatus to the shut-down value for the setpoint condensation pressure. During shut-down, the optimal condensation pressure may decrease too rapidly so that at the pump, there is abutting a too low pressure compared to the fluid temperature so that the pump cavitates. Due to limiting the maximal modification speed of the setpoint condensation pressure, this problem can be avoided.

According to a further embodiment, also during regular operation (after starting the operation), the modification speed of the setpoint condensation pressure is limited to a maximal pressure modification speed. Thereby, this value for positive and negative pressure modifications may be different in respect of the amount.

The above mentioned underlying problem is further solved by a thermal cycle apparatus according to claim 9.

The thermal cycle apparatus according to the invention, in particular an ORC apparatus, comprises: a feed pump for conveying liquid working medium with an increase in pressure to an evaporator, the evaporator for evaporating and optionally additionally superheating the working medium with a supply of heat, an expansion machine for generating mechanical energy by expansion of the evaporated working medium; a generator for at least partially converting the mechanical energy into electrical energy, the condenser for condensing the expanded working medium; a control and regulation device for determining a temperature of cooling air supplied from the condenser without using temperature sensors; determining a condensation setpoint pressure at which the net electrical power of the thermal cycle apparatus is at a maximum from a determined or measured generator or expansion machine rotational speed and the determined cooling air temperature, and for controlling or regulating the condensation pressure with the setpoint condensation pressure as target value by adjusting a condenser fan rotational speed. The advantages mentioned in connection with the method according to the invention equally apply here.

The device according to the invention may be further developed in a way that it furthermore comprises a rotational speed sensor for measuring a rotational speed of the generator or the expansion machine; and/or a further rotational speed sensor for measuring a condenser fan rotational speed; and/or a pressure sensor for measuring the condensation pressure.

The mentioned embodiments may be applied individually or may appropriately be combined with one another.

Further features and exemplary embodiments as well as advantages of the present invention are explained in detail by means of the drawings. It is clear that the embodiment do not exhaust the range of the present invention. It is furthermore clear that some or all features subsequently described may also be otherwise combined with one another.

DRAWINGS

FIG. 1 shows a device according to the invention.

EMBODIMENTS

FIG. 1 shows an embodiment of the device according to the invention. For the description of the method according to the invention, it is also referred thereto.

The thermal cycle apparatus comprises a feed pump 1 for conveying liquid working medium with an increase in pressure to an evaporator 2, the evaporator 2 for evaporating and optionally additionally superheating the working medium with a supply of heat, an expansion machine 3 for generating mechanical energy by expansion of the evaporated working medium, a generator 4 for at least partially converting the mechanical energy into electrical energy, and the condenser 5 for condensing the expanded working medium. Further, a rotational speed sensor 6 may be provided for measuring the rotational speed of the generator 4. The generator's rotational speed, however, may be determined from electrical signals from or to the generator 4. Moreover, a control device 7 is provided for determining a temperature of cooling air supplied from the condenser without using temperature sensors; determining a condensation setpoint pressure at which the net electrical power of the thermal cycle apparatus is at a maximum from a determined or measured generator or expansion machine rotational speed and the determined cooling air temperature, and for regulating the condensation pressure with the setpoint condensation pressure as target value by adjusting a condenser fan rotational speed. Further, a rotational speed sensor 8 for measuring the rotational speed of the condenser fan and a pressure sensor 9 for measuring the condensation pressure in the condenser 5 may be provided.

The essential concept of the invention is to control the condensation pressure in the condenser 5 in a way that a possibly large net energy gain is achieved. For this purpose, a functional relation from important system parameters and a setpoint condensation pressure being optimal for every load point is formulated. This relation is derived from a model of the system within its environment:

$$p_{COND,opt}=f(s_{GEN},T_\infty) \quad (1)$$

Thereby, $s_{GEN}$ is the rotational speed of the generator and T=the temperature of the supplied air (outside temperature). In an embodiment of the invention, from a model of the system, the appropriate outside temperature can be concluded for every system status.

$$T_\infty{}^*=f(s_{GEN},s_{COND},p_{COND}) \quad (2)$$

This calculated value $T_\infty{}^*$ for the outside temperature may be used in equation (1) for the optimal setpoint condensation pressure. For this, the generator rotational speed $s_{GEN}$, the condenser fan rotational speed $s_{COND}$, and the condensation pressure $p_{KOND}$ enter the calculation.

For the quantification of the power transmitted by the system (load point), the generator rotational speed $s_{GEN}$ is used. With a higher rotational speed (upon an actual live steam status), a higher amount of the medium is supplied through the system. Correspondingly, the feed pump has to supply more of the same. Consequently, the generator rotational speed may be used as degree for the supplied power. In particular, when using volumetric expansion machines and nearly constant live steam parameters, this is an easy possibility to quantify the thermal power, as the volume flow then in a very good approximation proportionally to the rotational speed of the expansion machine. Due to the direct coupling of the generator, $s_{GEN}$ is equivalent to the rotational speed of the expansion machine.

Considering the optimal condensation pressure at a relevant area of ambient temperature and generator rotational speed, a mathematical relation of these three values can be determined. This formal description may enter the regulation of the condensation pressure via the control of the condenser rotational speed.

Applying this mathematic relation graphically, it can be recognized that a clear optimal setpoint condensation pressure can be associated to every ambient temperature and generator rotational speed, compare equation (1). With an increasing outside temperature at a constant rotational speed, a higher optimal setpoint condensation pressure results. With a constant outside temperature with an increasing generator rotational speed, and thus, expansion machine rotational speed, a higher optimal setpoint condensation pressure results.

Outside temperature determination without measuring: The objective is now to specify a quantitative statement on the environmental conditions (temperature of the supplied air) from system internal values.

The condensation pressure predominant in the condenser during the operation is affected by the heat dissipated in the condenser. It can be demonstrated that the heat dissipation of the condenser can be described in different ways by means of 4 variables, namely $T_\infty$, $s_{COND}$, $s_{GEN}$, and $p_{COND}$. Due to these relations, then by eliminating the heat dissipation, a relation between the 4 variables can be derived in the equations. By determining this mathematical relation, thus, a quantitative statement on the current, the condenser affecting environmental conditions can be presented. From this relation, then, the temperature of the supplied air $T_\infty$ (thus, the effective temperature $T_\infty{}^*$) can be determined from the other three variables. Therefore, the value, which can only be calculated from system internal variables, can enter into the described condenser regulation.

According to the invention, a method for regulating a condenser in a thermal cycle apparatus, in particular in an ORC apparatus is provided, wherein the method comprises the following steps: determining, in particular measuring, a rotational speed of the generator 4 or of the expansion machine 3; determining, without the use of a temperature sensor, a temperature $T_\infty{}^*$ of cooling air supplied from the condenser 5; determining a condensation setpoint pressure at which the net electrical power of the thermal cycle apparatus is at a maximum; from the measured generator or expansion machine rotational speed and the determined cooling air temperature; and controlling or regulating the condensation pressure, with the condensation setpoint pressure as target value, in particular by adjusting a condenser fan rotational speed.

The presented embodiments are only exemplary and the complete extent of the present invention is defined by the claims.

The invention claimed is:

1. A method for regulating a condenser in a thermal cycle apparatus, wherein the thermal cycle apparatus comprises a feed pump for conveying liquid working medium with an increase in pressure to an evaporator, the evaporator for evaporating the working medium with a supply of heat, an expansion machine for generating mechanical energy by expansion of the evaporated working medium, a generator for at least partially converting the mechanical energy into electrical energy, and the condenser for condensing the expanded working medium, and wherein the method comprises the following steps:

determining a rotational speed of the generator or of the expansion machine;

determining, without the use of a temperature sensor, a temperature of cooling air supplied from the condenser;

determining from the determined generator or expansion machine rotational speed and the determined cooling air temperature, a condensation setpoint pressure at which a net electrical power of the thermal cycle apparatus is at a maximum; and controlling or regulating a condensation pressure, with the condensation setpoint pressure as a target value by adjusting a condenser fan rotational speed, wherein determining the temperature of cooling air supplied from the condenser further comprises one of (i) calculating the temperature of cooling air from the determined rotational speed of the generator or of the expansion machine, a determined rotational speed of the condenser fan and a determined condensation pressure, or (ii) sampling the temperature of cooling air from a predetermined table dependent upon the determined rotational speed of the generator or of the expansion machine, a determined rotational speed of the condenser fan and a determined condensation pressure.

2. The method according to claim 1, further comprising at least one selected from the group of (i) determining the rotational speed of the generator or the expansion machine further comprises measuring the rotational speed of the generator or the expansion machine (ii) determining the rotational speed of the condenser fan by measuring the rotational speed of the condenser fan, and (iii) determining the condensation pressure by measuring the condensation pressure.

3. The method according to claim 2, wherein during starting the thermo-dynamic cycle apparatus, initially, the following steps are carried out:

determining a start value for the condensation setpoint pressure;

starting the thermo-dynamic cycle apparatus and controlling or regulating the condensation pressure with the start value of the condensation setpoint pressure as a target value by means of adjusting the condenser fan rotational speed; and replacing the start value for the condensation setpoint value with the condensation setpoint value determined during the operation of the thermo-dynamic cycle apparatus.

4. The method according to claim 2, wherein subsequent to a shut-down of the thermo-dynamic cycle apparatus, the following steps are carried out:

determining a shut-down value for the setpoint condensation pressure;

replacing the setpoint condensation pressure determined during operation of the thermo-dynamic cycle apparatus with the shut-down value for the setpoint condensation pressure; and controlling or regulating the condensation pressure with the shut-down value as a target value by means of adjusting the condenser fan rotational speed and stopping the operation of the thermo-dynamic cycle apparatus.

5. The method according to claim 1, wherein during starting the thermo-dynamic cycle apparatus, initially, the following steps are carried out:

determining a start value for the condensation setpoint pressure;

starting the thermo-dynamic cycle apparatus and controlling or regulating the condensation pressure with the start value of the condensation setpoint pressure as a target value by means of adjusting the condenser fan rotational speed; and replacing the start value for the condensation setpoint value with the condensation setpoint value determined during the operation of the thermo-dynamic cycle apparatus.

6. The method according to claim 5, wherein a start value for the condensation setpoint value the saturation pressure of the working medium at the current condensate temperature or the saturation pressure at the temperature of the working medium at an inlet of the feed pump, the actual pressure in standstill of the thermo-dynamic cycle apparatus, or the last condensation setpoint pressure during the last operation of the thermo-dynamic cycle apparatus can be determined.

7. The method according to claim 6, wherein replacing comprises controlling or regulating the condensation pressure from the start value of the condensation pressure to the setpoint condensation pressure determined during the operation of the thermo-dynamic cycle apparatus.

8. The method according to claim 6, wherein subsequent to a shut-down of the thermo-dynamic cycle apparatus, the following steps are carried out:

determining a shut-down value for the setpoint condensation pressure;

replacing the setpoint condensation pressure determined during operation of the thermo-dynamic cycle apparatus with the shut-down value for the setpoint condensation pressure; and controlling or regulating the condensation pressure with the shut-down value as a target value by means of adjusting the condenser fan rotational speed and stopping the operation of the thermo-dynamic cycle apparatus.

9. The method according to claim 5, wherein replacing comprises controlling or regulating the condensation pressure from the start value of the condensation pressure to the setpoint condensation pressure determined during the operation of the thermo-dynamic cycle apparatus.

10. The method according to claim 9, wherein subsequent to a shut-down of the thermo-dynamic cycle apparatus, the following steps are carried out:

determining a shut-down value for the setpoint condensation pressure;

replacing the setpoint condensation pressure determined during operation of the thermo-dynamic cycle apparatus with the shut-down value for the setpoint condensation pressure; and controlling or regulating the condensation pressure with the shut-down value as a target value by means of adjusting the condenser fan rotational speed and stopping the operation of the thermo-dynamic cycle apparatus.

11. The method according to claim 5, wherein subsequent to a shut-down of the thermo-dynamic cycle apparatus, the following steps are carried out:

determining a shut-down value for the setpoint condensation pressure;

replacing the setpoint condensation pressure determined during operation of the thermo-dynamic cycle apparatus with the shut-down value for the setpoint condensation pressure; and controlling or regulating the condensation pressure with the shut-down value as a target value by means of adjusting the condenser fan rotational speed and stopping the operation of the thermo-dynamic cycle apparatus.

12. The method according to claim 1, wherein subsequent to a shut-down of the thermo-dynamic cycle apparatus, the following steps are carried out:

determining a shut-down value for the setpoint condensation pressure;

replacing the setpoint condensation pressure determined during operation of the thermo-dynamic cycle apparatus with the shut-down value for the setpoint condensation pressure; and controlling or regulating the condensation pressure with the shut-down value as a target value by means of adjusting the condenser fan rotational speed and stopping the operation of the thermo-dynamic cycle apparatus.

13. The method according to claim 12, wherein as shut-down value the last setpoint condensation pressure during the last operation of the thermo-dynamic cycle apparatus or the saturation pressure of the working medium at current condensate temperature is specified.

14. The method according to claim 13, wherein replacing comprises a controlling and regulating the condensation pressure of the setpoint condensation pressure determined during operation of the thermo-dynamic cycle apparatus to the shut-down value for the setpoint condensation pressure.

15. The method according to claim 12, wherein replacing comprises a controlling and regulating the condensation pressure of the setpoint condensation pressure determined during operation of the thermo-dynamic cycle apparatus to the shut-down value for the setpoint condensation pressure.

16. A thermal cycle apparatus, comprising:

a feed pump for conveying liquid working medium with an increase in pressure to an evaporator, the evaporator for evaporating the working medium with a supply of heat;

an expansion machine for generating mechanical energy by expansion of the evaporated working medium;

a generator for at least partially converting the mechanical energy into electrical energy;

a condenser for condensing the expanded working medium;

a control and regulation device for determining a temperature of cooling air supplied from the condenser from a determined rotational speed of the generator or the expansion machine, a determined rotational speed of the condenser fan and a determined condensation pressure; determining a condensation setpoint pressure at which a net electrical power of the thermal cycle apparatus is at a maximum from a determined or measured generator or expansion machine rotational speed and the determined cooling air temperature, and for controlling or regulating the condensation pressure with the setpoint condensation pressure as a target value;

a rotational speed sensor for measuring the rotational speed of the generator or the expansion machine;

a pressure sensor for measuring the condensation pressure; and a further rotational speed sensor for measuring the rotational speed of the condenser fan.

17. A thermal cycle apparatus according to claim 16, wherein the evaporator is further configured for superheating the working medium with the supply of heat.

* * * * *